US006247449B1

(12) United States Patent
Persson

(10) Patent No.: US 6,247,449 B1
(45) **Date of Patent: *Jun. 19, 2001**

(54) METHOD FOR REDUCING VIBRATION IN A VEHICLE AND A DEVICE FOR ACCOMPLISHMENT OF THE METHOD

(75) Inventor: Per Persson, Partille (SE)

(73) Assignee: AB Volvo (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/091,585

(22) PCT Filed: Dec. 20, 1996

(86) PCT No.: PCT/SE96/01745

§ 371 Date: Aug. 25, 1998

§ 102(e) Date: Aug. 25, 1998

(87) PCT Pub. No.: WO97/23716

PCT Pub. Date: Jul. 3, 1997

(30) Foreign Application Priority Data

Dec. 22, 1995 (SE) ..... 9504603

(51) Int. Cl.[7] ..... F02D 17/02
(52) U.S. Cl. ..... 123/436; 123/192.1; 123/481
(58) Field of Search ..... 123/198 DB, 192.1, 123/436, 321, 322, 481, 198 F; 417/237

(56) References Cited

U.S. PATENT DOCUMENTS

| | | | | |
|---|---|---|---|---|
| 2,676,752 | * | 4/1954 | Ochel et al. | 417/237 |
| 3,426,523 | * | 2/1969 | Straub | 60/600 |
| 3,963,379 | * | 6/1976 | Ueno | 417/237 |
| 4,040,395 | | 8/1977 | Demetrescu . | |
| 4,172,434 | | 10/1979 | Coles . | |
| 4,492,192 | | 1/1985 | Baguelin . | |
| 5,101,791 | * | 4/1992 | Kuettner et al. | 123/436 |
| 5,230,609 | * | 7/1993 | Tseng et al. | 417/237 |
| 5,450,830 | * | 9/1995 | Katoh | 123/443 |
| 5,669,354 | * | 9/1997 | Morris | 123/419 |
| 5,678,520 | * | 10/1997 | Hori et al. | 123/419 |
| 5,709,192 | * | 1/1998 | Zimmermann | 123/436 |
| 5,906,187 | * | 5/1999 | Heuer | 123/436 |

FOREIGN PATENT DOCUMENTS

WO 94/29585 12/1994 (WO) .

* cited by examiner

*Primary Examiner*—Tony M. Argenbright
(74) *Attorney, Agent, or Firm*—Lerner, David, Littenberg, Krumholz & Mentlik, LLP

(57) ABSTRACT

A method and an arrangement for reducing vibrations in an internal combustion engine (2) which has a plurality of drive units (3–8) connected to a common output shaft (9). These are equipped with a combustion chamber and inlets (34–39) for fuel from organs for fuel supply. Any one of the driving units (7) can be switched from a normal operating condition to an alternative operating condition, in which the supply of fuel to the drive unit is blocked, which causes an alteration in the torque of the driving unit which has been thus switched. The amount of fuel supplied to the drive units which are in a normal operating condition is distributed according to a chosen pattern in order to create torques in these which cause a chosen suppresion of vibrations.

13 Claims, 6 Drawing Sheets

Figure 1:
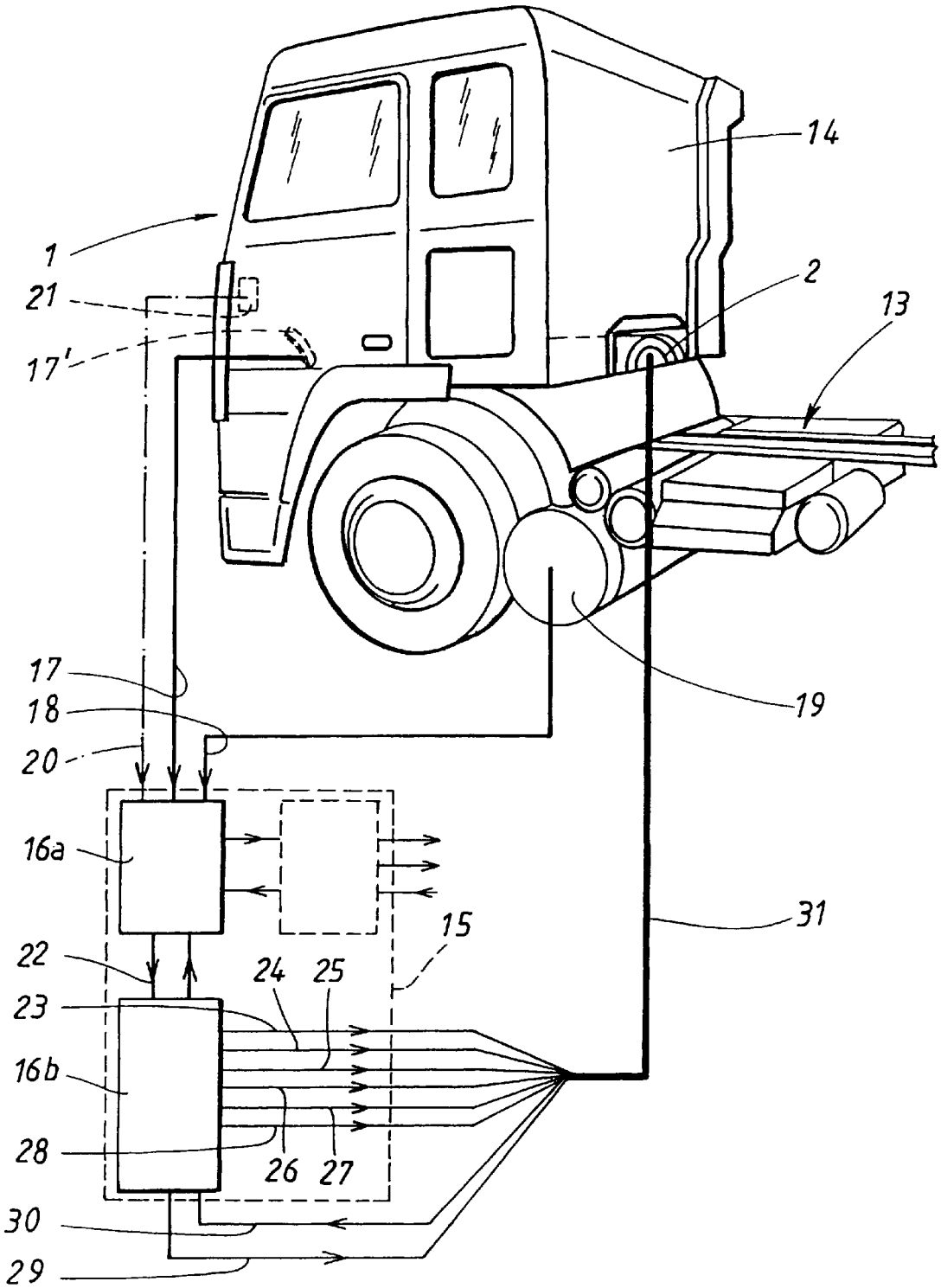

METHOD FOR REDUCING VIBRATION IN A VEHICLE AND A DEVICE FOR ACCOMPLISHMENT OF THE METHOD

TECHNICAL FIELD

The present invention relates to a method and an arrangement which are intended to be used to suppress vibrations which occur in a vehicle due to imbalances in an engine in the vehicle.

TECHNICAL BACKGROUND

There are a number of vehicles, for example trucks, which have systems which consume, and are driven by, compressed air. In order for these systems to function, access to compressed air is necessary. Access to compressed air is usually achieved by a compressor which compresses air, which is then stored in pressure tanks where it is ready to be used by the compressed air users of the vehicle. The compressor is usually driven by the engine of the vehicle. Such a system needs to be fitted with a compressor, which increases the weight and fuel consumption of the vehicle. In order to make a vehicle financially more attractive, reducing the number of necessary components of the vehicle is of interest.

In a piston engine with a plurality of cylinders, in certain operational conditions one or more of the cylinders can be switched from normal combustion in order to temporarily be used for other purposes, such as for example an air compressor to fill compressed air tanks in a vehicle, which would replace a separate compressor. The compressor function is achieved by a cylinder room which can be connected to the compressed air tanks. This connection is closed during normal operation, and is opened when the cylinder is to be used as a compressor. When one or more cylinders are used as compressors, fuel supply to their corresponding cylinder space is cut off. When such a system is used, the pressure curve in the cylinder will have substantially different characteristics as compared to when the cylinder is used for conventional operation. During conventional operation, each cylinder has a compression stroke and an expansion stroke. During the expansion stroke, power is supplied to the system, and during the compression stroke the piston supplies power to the enclosed gas. If one or more cylinders are used to compress air, no normal expansion stroke will take place. This radically changes the pressure curve in the cylinder, and thus the torque which is transferred to the crankshaft of the engine. Due to the above mentioned changes of the pressure curve of the cylinder, the engine is not balanced in the same way as if all the cylinders were used for conventional operation. This causes the generation of vibrations with substantially different frequency components. A corresponding phenomena will occur when one or more cylinders are not used for their main purpose for other reasons.

SUMMARY OF THE INVENTION

The object of the present invention is to create a method and an arrangement which suppresses vibrations which are generated by an engine in which one or more cylinders are used for another purpose than combustion, in order to reduce disturbing vibrations in the surroundings of the engine such as connected driving rope and/or driving-compartment.

THE FIGURES

Figure 2:
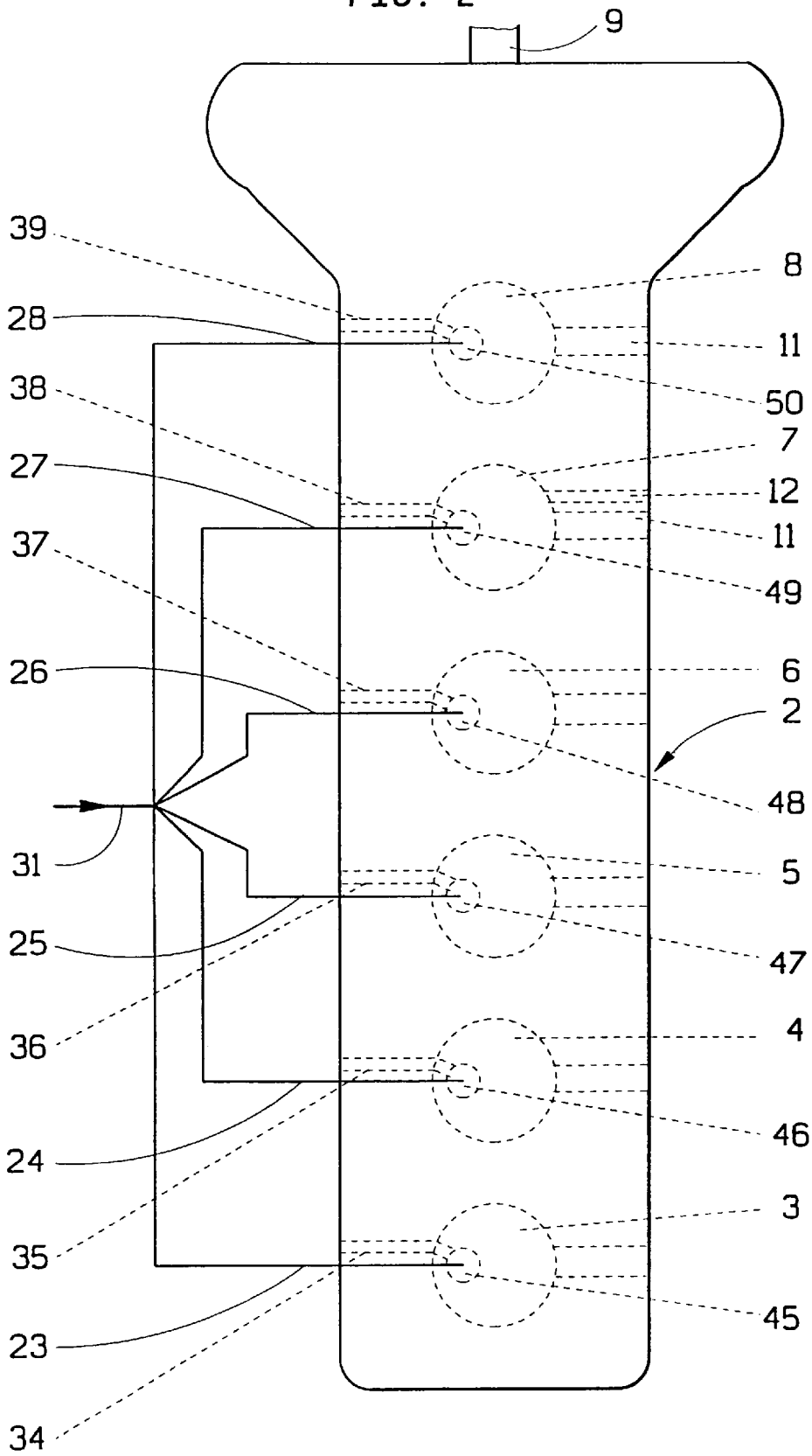
Figure 3:
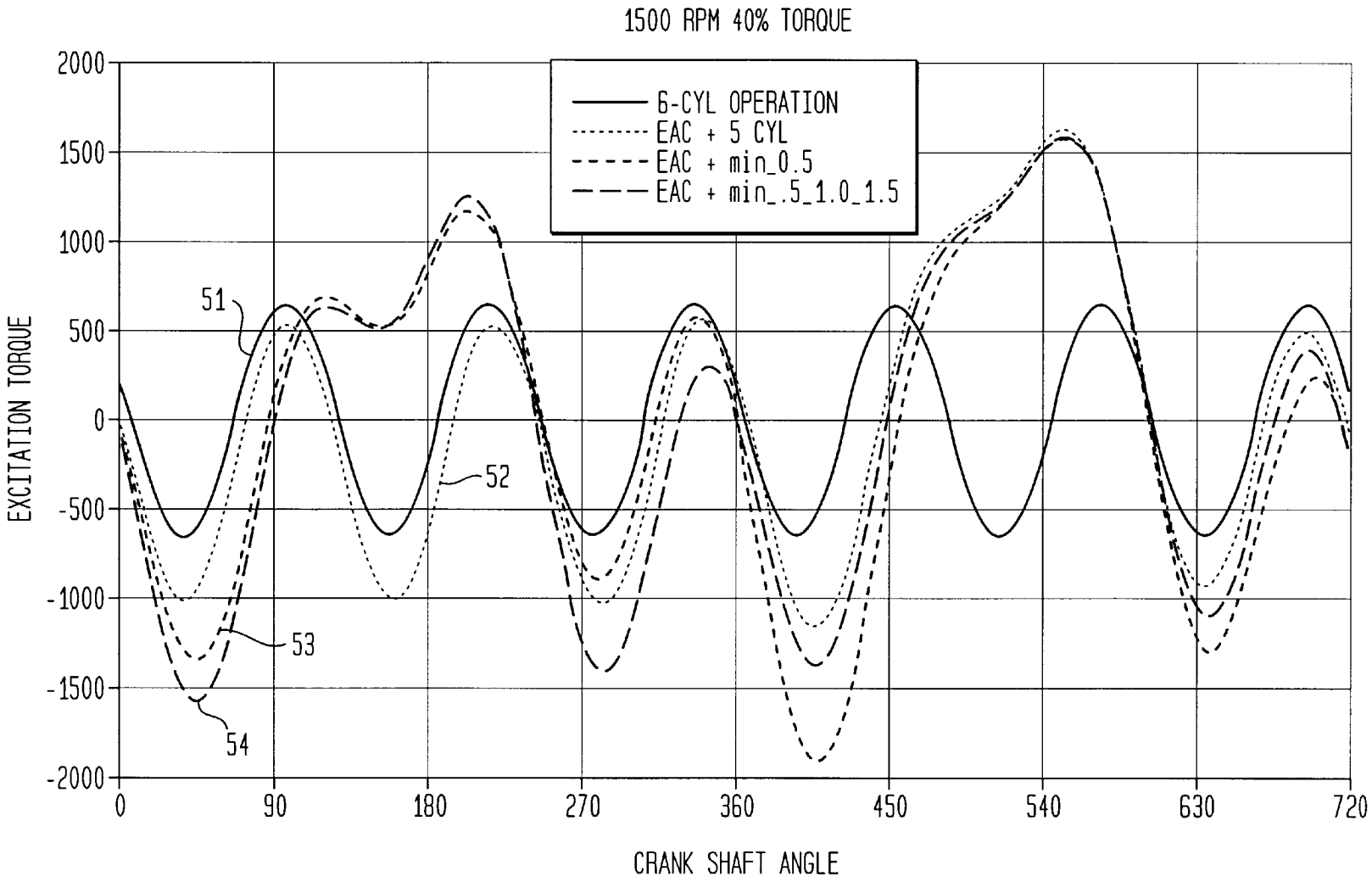
Figure 8:
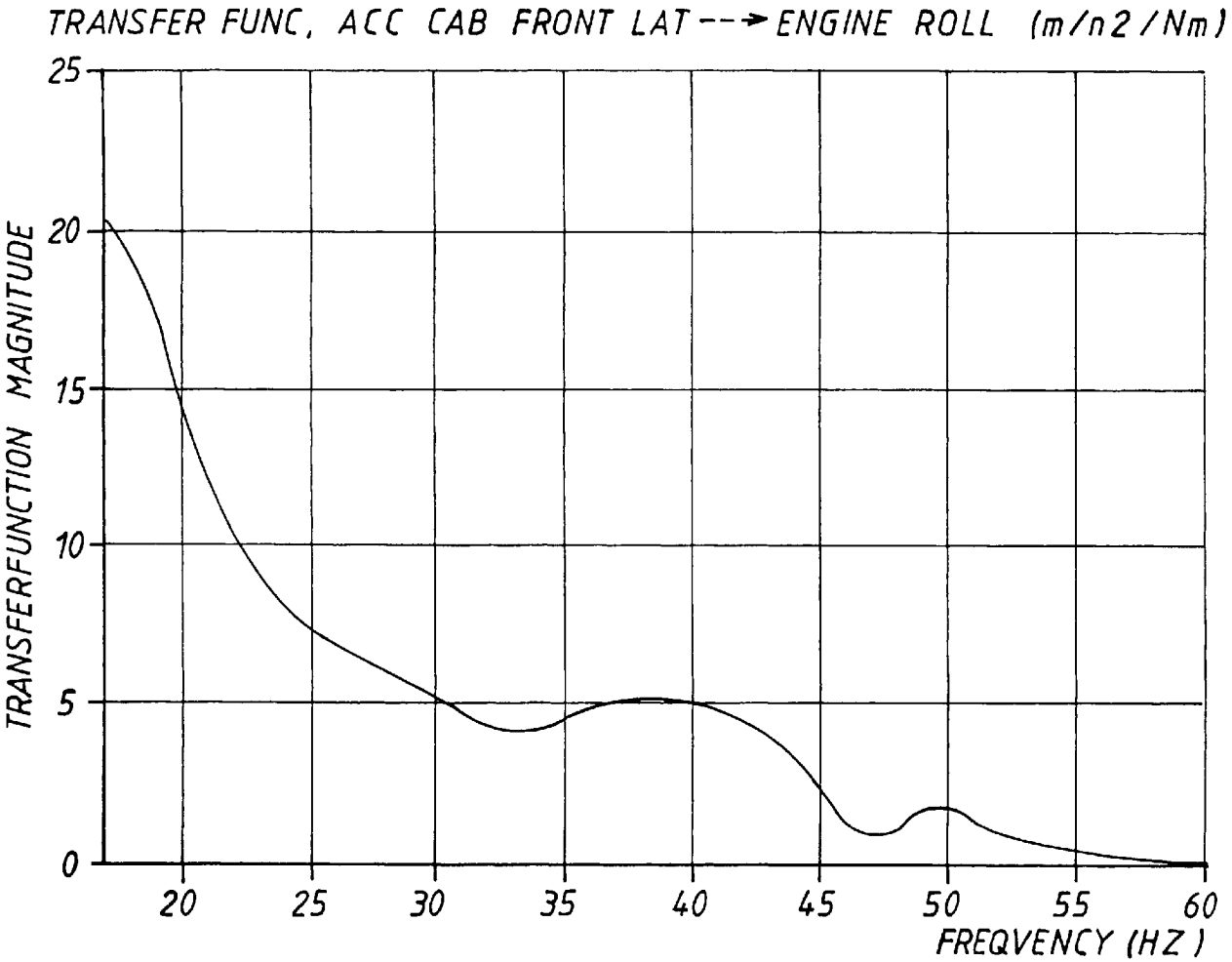

The invention will in the following be described in more detail by means of an example of an embodiment, with reference to the appended drawings, in which:

FIG. 1 schematically shows a part of a cargo vehicle which is equipped with an arrangement according to the invention, FIG. 2 schematically shows an internal combustion engine which is equipped with a fuel unit of an arrangement according to the invention, FIG. 3 with a diagram shows torque variations during different operational conditions, FIGS. 4–7 with different vector diagrams show the torque created during different operational conditions, and FIG. 8 shows a diagram of sensitivity for vibrational disturbances.

EMBODIMENTS

Even during normal operation, a conventional internal combustion engine, for example a piston engine in a motor vehicle, generates a torque which varies with the revolution of the crankshaft. This is due to the fact that each cylinder during one or several, usually two revolutions, goes through different strokes at different angles of the crankshaft for different cylinders, with i.a. a compression stroke which consumes energy and thus affects the crankshaft with a negative torque, and an expansion stroke which supplies power to the piston, and thus causes a positive torque on the crankshaft. When all of the cylinders are in conventional operation, with a smooth supply of fuel to all of the cylinders in a multi-cylinder engine (three or more cylinders), the engine is highly balanced and a minimum of low vibration frequencies are caused. The invention relates to internal combustion engines which are arranged to enable the switching of one or more of the engine cylinders to an alternative operational condition, for example as air compressor by blocking the supply of fuel and thus only supplying air, wherein the outlet is switched to feed compressed air to a compressed air reservoir which is used to supply equipment in the vehicle which is driven by compressed air, for example the brake system. As mentioned initially, this changes the expansion stroke, thus changing the torque variation during the revolution of the crankshaft of the switched cylinder or cylinders.

According to the invention, the change in torque is counteracted by changing the torque-curve during revolution of the remaining (at least two) cylinders, which are in normal operational condition in such a way that the imbalance caused by switching the operational state of the remaining cylinders is compensated for, which is achieved by differentiating the amount of fuel supplied to the driving cylinders, i.e. each cylinder is given a specifically chosen amount or proportion of fuel. Utilizing knowledge of the degree of efficiency of an internal combustion engine and other operational data, there is an unambiguous correlation between the amount of fuel and the torque caused in each cylinder during its expansion stroke. By means of a large amount of experiments or calculations, it is possible to calculate how the torques should be distributed for each driving cylinder in order to optimally suppress vibration frequencies in the engine, whereby the differentiation of the amount of fuel supplied can be calculated. The differentiation of the fuel amount is done as a percentual differentiation and/or a calculation of the absolute amount of fuel per cylinder and revolution, based on an unambiguous correlation between the total amount of fuel per combustion and the desired average torque of the crankshaft.

The control system for control of the differentiated fuel supply can either be an open control system with a control unit which has a large amount of stored data which describes the individual amount of fuel for each cylinder for different operational conditions, such as RPM and load level of the engine, which have been arrived at through a combination of calculations and simulations, so-called "mapping", or an adaptive control system with sensors which detect vibrations in the vehicle, and which via the control unit control the differentiated fuel supply.

FIG. 1 very schematically shows the two control systems and shows a part of a truck 1 equipped with an internal combustion engine 2. The engine is an internal combustion engine, and of the multi-cylinder piston type engine, as schematically shown in a top-view in FIG. 2. The engine is further of the kind which has a discontinuous combustion curve, and thus a torque for each cylinder which varies during revolution. In the example shown, the piston engine is of the kind with pistons which move back and forth, and which in the shown example has six combustion units, i.e. cylinders 3–8. Furthermore, the engine has a crankshaft which is common for all the cylinders with a conventional crank shaft angle sequence so that the torque additions for the cylinders will occur with an angular displacement between them, causing the resulting torque on the crankshaft, and thus the outgoing shaft to be as smooth as possible during a revolution.

As mentioned above, at least one of the cylinders, in the example shown the fifth cylinder 7 as counted from the front, is switchable between a normal operational state to an alternative state in which the cylinder 7 no longer serves as driving unit for propelling the vehicle, but is used as a load, driven by the remaining driving units, for example as an air compressor for driving compressed air driven auxiliary systems in the vehicle, for example the brake system. For this purpose, the fuel inlet 38 of the cylinder 7 in question is arranged to be closed completely when switching to this alternative state. For some purposes, e.g. rapid heating of the catalyzer in the exhaust system, the fuel inlet 38 can alternatively be open to a certain extent. The ignition in cylinder 7 is here switched off, to let unused fuel pass through to the catalyzer. Furthermore, the cylinder, apart from its exhaust outlet 11, is equipped with a compressed air outlet 12 which, by means of a not shown valve can be opened, and which is connected to a not shown compressed air reservoir. As mentioned above, this alternative state causes imbalances in the engine if no special measures are taken to compensate the change in torque which is caused in the cylinder 7 during revolution of the engine.

In order to reduce vibrations in the engine 2, which are transmitted to different parts of a vehicle, for example to a driving rope, and via the chassis 13 of the vehicle to the driving compartment 14 of the vehicle, there is, according to the invention arranged a control system which differentiates, i.e. individually distributes the amount of fuel to each of the cylinders 3–6, 8, which are working in a normal operational state. For this purpose the vehicle is equipped with a control system 15 which can either be central or decentralized. A decentralized controls system can, e.g. as in the example here shown, consist of two control units, one car control unit 16*a* and an engine control unit 16*b*. The car control unit 16*a* is intended to mainly process signals from/to chassis and driving compartment, while the engine control unit 16*b* is intended to mainly give output data to control the fuel system of the engine. The control system can, as mentioned above, either be an open control system or a closed, adaptive control system. The open control system has a large amount of stored data, based on a large amount of tests during different operational states, during which measurement of vibration modes in the driving compartment are carried out.

In the open control system, the car control system 15*a* has an input 17 which receives an in-signal regarding the current amount of gas, i.e. is arranged to sense the position of the gas pedal 17 in order to thereby give control instruction regarding desired torque on the outgoing shaft 9 of the engine. A further control input 18 is arranged to, to the car control unit 16*a* feed a control signal which indicates the air pressure in a compressed air reservoir 19, and thus the need for compressed air in order to control the switching between a normal operational state of the cylinder 78, and an alternative operational state to generate compressed air. In an embodiment with a closed adaptive control system, there is arranged a third control input 20 which is indicated with lines and dots, and which is arranged to, to the car control unit 16*a* feed a control signal from a vibration sensor 21 in the driving compartment 14, which thus creates a direct feedback of vibrations which occur in the driving compartment and which are to be suppressed with the control system according to the invention. Examples of other control parameters are RPM, vehicle speed, gear, etc.

The engine control unit 16*b* is connected to the car control unit 16*a* with bi-directional communication, and is arranged to transfer control signals from the car control unit 16*a* on an input 22 to control instructions on a number of outputs 23–29 for differentiation, i.e. distribution of the amount of fuel to the cylinders 3–6, 8, which are in a normal operational state, and for controlling the switchable cylinder 7 between its two operational states.

As shown schematically in FIGS. 1 and 2, all of the outputs 23–29 and a return input 30, are shown as one single connection 31, and are arranged to control fuel injection units 45–50 which have incoming fuel feed lines for the supply of fuel to the respective inlets 34, 35, 36, 37, 38, 39 to each cylinder 3–8.

FIG. 3 with a diagram shows torque variations during two revolutions of the crankshaft in a diesel engine, which is the necessary amount in order for each cylinder in a six-cylinder diesel engine to go through all strokes. Curve 51 shows an essentially sine-shaped, regular third order torque curve in a normal operational state of all the six cylinders, while curve 52 shows a state where EAC (Engine Air Compressor) is activated, see U.S. Pat. No. 467,503, i.e. The fifth cylinder 7 is in a compressor state, whereby the torque is raised when the crankshaft is at certain angles. Curves 53 and 54 show a state according to the invention where differentiated amounts of fuel have caused an increased torque at certain angles of the crankshaft, with the amounts of fuel chosen so that 0.5th order vibrations have been suppressed, see curve 53, and 0.5th and 1.5th order vibrations have been suppressed, see curve 54 which will be discussed in detail below.

Figure 4A:
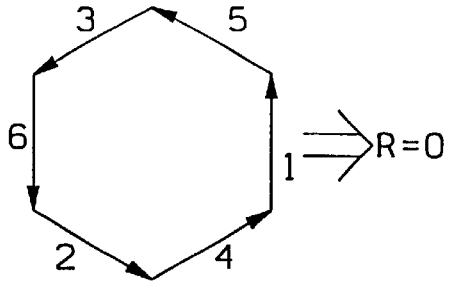
Figure 5A:
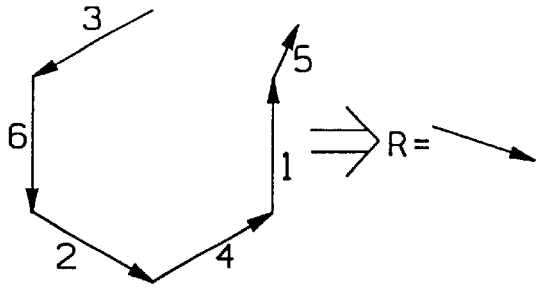
Figure 4B:
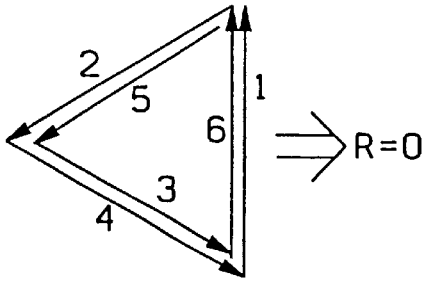
Figure 5B:
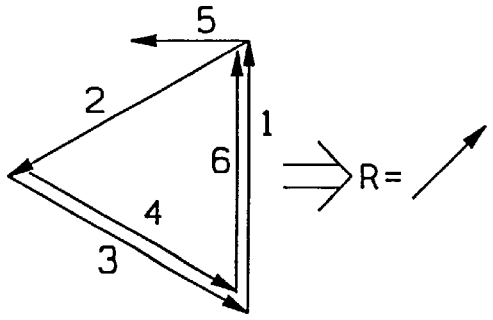
Figure 4C:
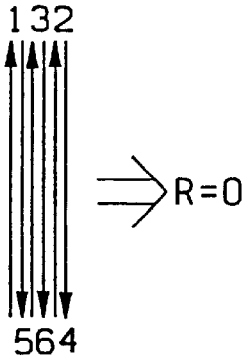
Figure 5C:
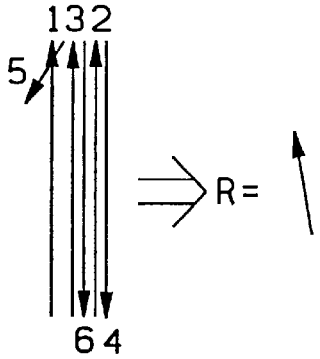
Figure 4D:
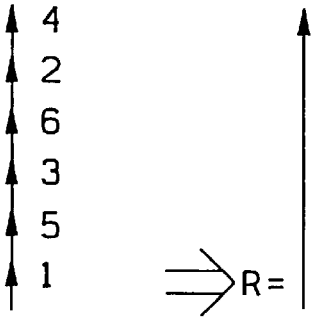
Figure 5D:
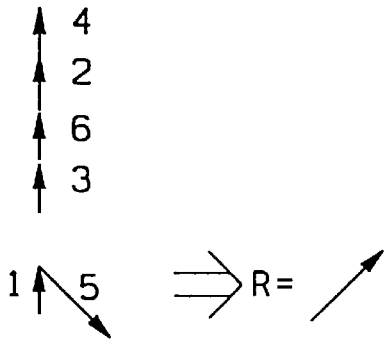

Tests and calculations have shown that all of the vibrations cannot be suppressed in one and the same operational situation. This can be seen from the vector digrams in FIGS. 4, 5, 6 and 7, which show disturbances in torque at six-cylinder operational state, i.e. normal operational state, FIG. 4, and air compressor state of the fifth cylinder without reduction of vibrations, FIG. 5, and an air compressor state of the fifth cylinder with suppression of 0.5th order vibration modes, FIG. 6, and air compressor state with suppression of 0.5th and 1.5th order vibrations, FIG. 7. FIGS. 4*a, b* and *c* show that no vibrations are caused at 0.5th, 1.0 and 1.5th order vibrations, while on the other hand, according to FIG. 4*d* 3.0 order vibrations are not suppressed. These are generally of such a frequency that they do not cause any disturbing transfer of vibrations to the driving compartment.

FIG. 5 shows that vibrations are caused at 0.5th and 1.0, 1.5th and 3.0 order vibrations, which thus in practice causes a very noticeable transmission of vibrations to the driving compartment.

Figure 6A:
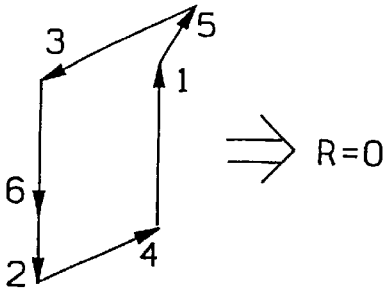
Figure 7A:
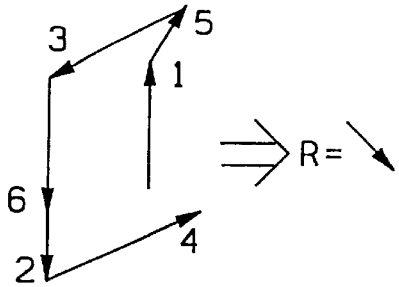
Figure 6B:
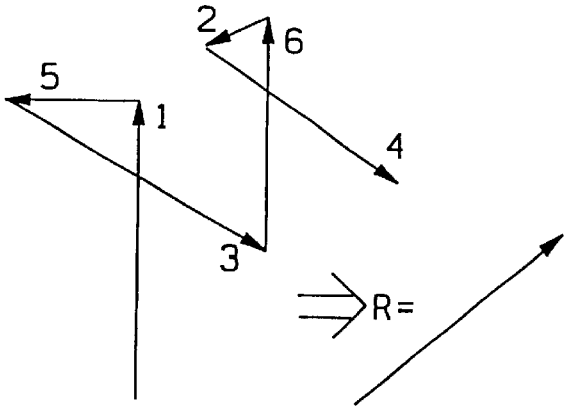
Figure 7B:
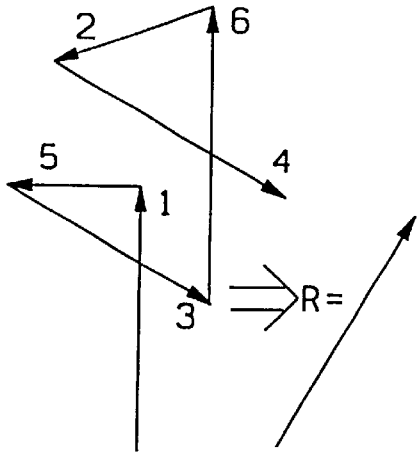
Figure 6C:
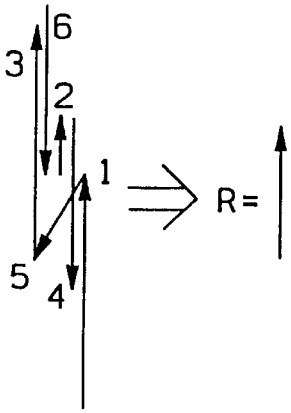
Figure 7C:
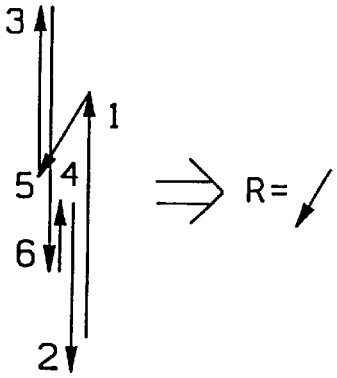
Figure 6D:
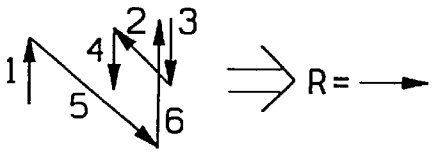
Figure 7D:
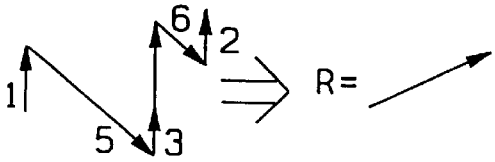

In the operational state according to FIG. 6, a certain differentiation and distribution of fuel has been chosen for the different cylinders 3–6, 8 in normal state, with such amounts of fuel chosen that 0.5th order vibrations have been suppressed, see FIG. 6*a*. FIGS. 6*b, c* and *d* show that 1.0, 1.5th and 3.0 order vibrations are not suppressed.

FIG. 7 shows an operational state with such a differentiation of fuel amount that the following orders are suppressed. FIG. 7*a* shows 0.5th order vibrations which are relatively well suppressed, FIG. 7*b* shows 1.0 order vibrations which are not suppressed, FIG. 7*c* shows 1.5th order vibrations which are relatively well suppressed, while finally FIG. 7*d* shows 3.0 order vibration mood which is suppressed to a relatively limited extent.

Calculations and experiments have shown that a distribution of fuel amount in the same proportions as the length of the vectors have caused the corresponding suppression of vibrations which has been achieved in the different operational states.

Tests with equal, respectively differentiated amounts of fuel have been carried out at different RPMs and different loads, in which was obtained the torque calculated which has the above described suppression of vibrations at different orders of vibration. Examples of values can be seen in the table below.

TABLE

Stationary driving with equal and differentiated amounts of fuel in mg/stroke, and calculated torque for orders 0.5–3.0

| Engine no 12-078<br>EAC on cyl 5 | cyl 1<br>mg/st | cyl 2<br>mg/st | cyl 3<br>mg/st | cyl 4<br>mg/st | cyl 5<br>mg/st | cyl 6<br>mg/st | 0.5<br>Nm | 1<br>Nm | 1.5<br>Nm | 2<br>Nm | 2.5<br>Nm | 3<br>Nm |
|---|---|---|---|---|---|---|---|---|---|---|---|---|
| 1800 rpm<br>Partial load<br>40% | 111.0 | 111.0 | 111.0 | 111.0 | EAC | 111.0 | 470 | 452 | 390 | 331 | 291 | 327 |
| 1800, rpm diff. _0.5 | 160.7 | 1.6 | 162.5 | 115.3 | EAC | 115.2 | 0 | 903 | 317 | 603 | 90 | 349 |
| 1800, rpm diff. _0.5 & 1.5 | 139.2 | 0 | 113.1 | 138.5 | EAC | 164.7 | 179 | 903 | 39 | 637 | 151 | 351 |
| 1800 rpm, Zero load<br>0 Nm | 24.0 | 24.0 | 24.0 | 24.0 | EAC | 26.0 | 148 | 147 | 136 | 121 | 112 | 851 |
| 1800, diff. _0.5 | 40.1 | 0 | 39.2 | 15.0 | EAC | 22.2 | 0 | 252 | 172 | 185 | 43 | 860 |
| 1200 rpm,<br>Partial load<br>40% | 117.2 | 117.2 | 117.2 | 117.2 | EAC | 117.2 | 478 | 454 | 402 | 333 | 291 | 646 |
| 1200, diff. _0.5 | 207.9 | 57.5 | 174.4 | 65.0 | EAC | 81.5 | 0 | 633 | 714 | 472 | 133 | 903 |
| 1200, diff. _0.5 & 1 & 2 | 174.2 | 209.0 | 196.5 | 0 | EAC | 0 | 158 | 84 | 1338 | 79 | 119 | 835 |
| 500 rpm, Zero load<br>0 Nm | 15.0 | 15.0 | 15.0 | 15.0 | EAC | 15.0 | 85 | 94 | 91 | 88 | 87 | 751 |
| 500 diff. _0.5 | 22.7 | 0 | 27.5 | 11.3 | EAC | 13.21 | 0 | 145 | 114 | 126 | 44 | 746 |
| 500, diff. _1 & 1.5 & 2 | 0 | 29.2 | 1.1 | 23.5 | EAC | 21.3 | 186 | 36 | 33 | 54 | 132 | 746 |

FIG. 8 shows the effect of different vibrational frequencies due to for example the natural frequency of the chassis. From this it can be seen that the effect varies greatly with the frequency, which forms the base for choosing suppression of certain orders of vibration. Those orders which cause large amplitudes of vibration in the surrounding parts of the vehicle are given priority, as opposed to those orders which cause small amplitudes.

The experiments have shown that a chosen differentiation of the amount of fuel supplied to the different cylinders causes a suppression of certain vibrations, and thus theoretically calculated caused torques correspond to those vibrations which have been measured.

What is claimed is:

1. A method for reducing vibrations in an internal combustion engine which has a crankshaft, at least three cylinders each having at least one inlet for fuel and units for fuel supply, the at least three cylinders including at least two cylinders having a normal operational state, during which the at least two cylinders are supplied with fuel, at least one cylinder of the at least three cylinders having a normal operational state, during which the at least one cylinder is supplied with fuel, and an alternative operational state, during which the at least one cylinder compresses air and during which the supply of fuel to the at least one cylinder is blocked, causing a change of torque transferred to the crankshaft, the method comprising:

a) distributing the amount of fuel supplied to the at least two cylinders according to the torque for each of the at least two cylinders required to suppress vibrations when the at least one cylinder is in the alternative operational state.

2. The method of claim 1, wherein the supply of fuel to the at least one cylinder is blocked when the at least one cylinder is switched to the alternative operational state.

3. The method of claim 2, further comprising calculating the amount of fuel which must be distributed to each of the at least two cylinders.

4. The method of claim 2, further comprising sensing vibrations in a vehicle in which the internal combustion engine is mounted.

5. The method of claim 2, further comprising calculating the torque for each of the at least two cylinders required to suppress vibrations.

6. The method of claim 2, further comprising controlling fuel injection units to distribute fuel among the at least two cylinders.

7. Apparatus for reducing vibrations in an internal combustion engine having at least three cylinders each having at least one inlet for fuel and units for fuel supply, the at least three cylinders including at least two cylinders having a normal operational state, during which the at least two cylinders are supplied with fuel, and at least one cylinder having a normal operational state, during which the at least one cylinder is supplied with fuel, and an alternative operational state, during which the at least one cylinder compresses air and during which the supply of fuel to the at least one cylinder is blocked, causing a change of torque transferred to the crankshaft, the apparatus comprising:

a) a control system arranged to distribute the amount of fuel supplied to the at least two cylinders based upon the torque required for each of the at least two cylinders in order to suppress vibrations when the at least one cylinder is in the alternative operational state.

8. The apparatus of claim 7, wherein said control system distributes fuel to the at least two cylinders based upon predetermined vibrations which are to be suppressed.

9. The apparatus of claim 7, further comprising fuel injection units arranged to block the supply of fuel to said at least one cylinder in the alternative operational state when said at least one cylinder is in the alternative operational state.

10. The apparatus of claim 7, wherein said at least one cylinder compresses air for auxiliary systems in an automobile when in the alternative operational state.

11. The apparatus of claim 7, further comprising a first sensor for sensing vibrations in a vehicle in which the internal combustion engine is mounted.

12. The apparatus of claim 11, wherein said first sensor is connected to said control system so that said first sensor feeds said control system information regarding vibrations to be used in calculating the amount of fuel which must be distributed to the at least two cylinders.

13. The apparatus of claim 11, further comprising a second sensor for sensing the air pressure in a compressed air reservoir to determine when said at least one cylinder must compress air.

* * * * *

UNITED STATES PATENT AND TRADEMARK OFFICE

CERTIFICATE OF CORRECTION

PATENT NO. : 6,247,449 B1
DATED : June 19, 2001
INVENTOR(S) : Per Persson

It is certified that error appears in the above-identified patent and that said Letters Patent is hereby corrected as shown below:

Title page,
Item [57], ABSTRACT, delete entire "ABSTRACT" and insert:

-- ABSTRACT

A method for reducing vibrations in an internal combustion engine which includes at least three cylinders, including at least two cylinders having a normal operational state and at least one of the cylinders having a normal operational state and an alternative operational state during which the at least one cylinder compresses air and the supply of fuel to that cylinder is blocked, the method comprising distributing the amount of fuel supplied to at least two of the cylinders according to the torque for each of the two cylinders required to suppress vibrations when the at least one cylinder is in the alternative operational state. An apparatus for reducing vibrations in an internal combustion engine is also disclosed. --

Column 1,
Line 28, after "as" insert -- , -- and after "for example" insert -- , --.
Line 62, after "as" insert -- a --.

Column 2,
Line 22, delete "i.a." insert -- i.e. --.

Column 3,
Line 23, after "shaft" insert -- , --.
Line 51, after "the invention" insert -- , --.
Line 56, delete "controls" insert -- control --.

Column 4,
Line 7, after "16a" insert -- , --.
Line 10, change "78" to -- 7 --.
Line 14, after "16a" insert -- , --.
Line 40, change "The" to -- the --.

UNITED STATES PATENT AND TRADEMARK OFFICE

CERTIFICATE OF CORRECTION

PATENT NO. : 6,247,449 B1
DATED : June 19, 2001
INVENTOR(S) : Per Persson

It is certified that error appears in the above-identified patent and that said Letters Patent is hereby corrected as shown below:

Column 5,
Line 54, after "to" insert -- , -- and after "for example" insert -- , --.

Signed and Sealed this

Sixth Day of August, 2002

*Attest:*

*Attesting Officer*

JAMES E. ROGAN
*Director of the United States Patent and Trademark Office*